US006485211B1

(12) United States Patent
Leo et al.

(10) Patent No.: US 6,485,211 B1
(45) Date of Patent: Nov. 26, 2002

(54) EASILY ASSEMBLED GRIP ELEMENT

(75) Inventors: Henry K. Leo, Guilford, CT (US); Craig M. Stevens, Bethany, CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/961,348

(22) Filed: Sep. 25, 2001

(51) Int. Cl.[7] ..... B43K 23/008; B43K 15/00

(52) U.S. Cl. ..... 401/6; 16/421; 401/88; 401/98; 401/202

(58) Field of Search ..... 401/6, 88, 98, 401/202; 16/421, 430

(56) References Cited

U.S. PATENT DOCUMENTS

| | | | | |
|---|---|---|---|---|
| 768,985 A | | 8/1904 | Goldsmith | |
| D63,874 S | | 2/1924 | Cleeland | |
| 2,173,451 A | | 9/1939 | Lorber | 120/103 |
| 2,236,194 A | | 3/1941 | Lorber | 120/103 |
| D203,234 S | | 12/1965 | Momma | D74/17 |
| D233,631 S | | 11/1974 | Defores | D74/17 |
| 3,941,491 A | | 3/1976 | Mutschler | 401/243 |
| D287,603 S | | 1/1987 | Bruhn | D19/48 |
| H1050 H | * | 5/1992 | Petrillo | 401/6 |
| D327,912 S | | 7/1992 | Tsai | D19/51 |
| D328,919 S | | 8/1992 | Bulgari | D19/51 |
| 5,186,564 A | | 2/1993 | Fuhrmann, III et al. | 401/202 |
| 5,230,578 A | | 7/1993 | Fuhrmann, III et al. | 401/202 |
| 5,558,452 A | | 9/1996 | Oka et al. | 401/6 |
| 5,599,127 A | | 2/1997 | Fuhrmann, III et al. | 401/202 |
| D404,426 S | | 1/1999 | Takanashi | D19/43 |
| 5,911,534 A | | 6/1999 | Toyama | 401/213 |
| 5,988,908 A | | 11/1999 | Kageyama et al. | 401/6 |
| 5,997,200 A | | 12/1999 | Kageyama et al. | 401/6 |
| D433,446 S | | 11/2000 | Rosenbaum | D19/51 |
| D438,903 S | | 3/2001 | Rosenbaum | D19/55 |
| 6,203,225 B1 | * | 3/2001 | Baudino et al. | 401/6 |
| 6,390,704 B1 | * | 5/2002 | Baudino et al. | 401/6 |
| 2001/0053307 A1 | | 12/2001 | Rigoni | 401/222 |

FOREIGN PATENT DOCUMENTS

| | | | |
|---|---|---|---|
| EP | 0 707 982 A1 | 4/1996 | B43K/23/008 |
| JP | 9272292 | 10/1997 | B43K/23/008 |
| JP | 10203077 | 8/1998 | B43K/23/008 |
| JP | 10217673 | 8/1998 | B43K/23/008 |
| JP | 11334272 | 12/1999 | B43K/3/00 |
| JP | 11334273 | 12/1999 | B43K/3/00 |
| JP | 11342691 | 12/1999 | B43K/3/00 |

* cited by examiner

*Primary Examiner*—David J. Walczak
*Assistant Examiner*—Kathleen J. Prunner
(74) *Attorney, Agent, or Firm*—Pennie & Edmonds LLP

(57) ABSTRACT

A grip element for mounting over a free end of a gripped article includes a gripping surface and an engagement surface extending from the gripping surface. The engagement surface is configured and dimensioned for engagement by a pushing device such that the pushing device sufficiently engages the engagement surface to push the engagement surface without use of an additional pushing device. The grip element is further configured and dimensioned with respect to the article such that the pushing device moves the grip element substantially completely onto the article without requiring lubrication or separate expansion of the grip element. Various features which improve the assembly of the grip element or article may be provided separately or in combination. A method of assembling the grip element onto the article is also disclosed.

31 Claims, 6 Drawing Sheets

EASILY ASSEMBLED GRIP ELEMENT

FIELD OF THE INVENTION

The present invention relates to a grip element for a hand-held and/or finger-manipulated article. More particularly, the present invention relates to a grip element which is easily assembled onto an article, such as a hand-held or finger-manipulated article.

BACKGROUND OF THE INVENTION

With the increasing attention to ergonomic designs, handle portions of hand-held or finger-manipulated articles are increasingly designed to enhance gripping thereof. For instance, handles are often contoured and/or textured to facilitate grasping. Such formation of handles has been known for many years. It has become increasingly desirable to enhance gripping even further by providing a grip element formed from a material different from the material of the handle portion. The different material may provide unique characteristics not achievable by the material from which the main body of the handle must be formed. For instance, hand-held and finger-manipulated articles may be formed from such materials as plastics or metals or woods which are hard and/or slippery. The provision of a grip element formed from a material different from that of the underlying article, such as rubber or foam, has become increasingly popular. Such grip elements may provide such benefits as reduced slippage (increased friction), an insulative effect (i.e., an element that is not cold to the touch), and/or cushioning.

Various grip elements formed from a material different from the material of the underlying article are known in the art. For instance, foam and rubber grip elements have been sold for many years for selective assembly onto a hand-held or finger-manipulated article to facilitate or to enhance grasping thereof. In addition, hand-held and finger-manipulated articles have also been sold with grip elements of materials different from the underlying material of the article already provided thereon. Such grip elements may be formed on the article by molding the material of the grip element onto the different underlying material of the article on which the grip element is to be provided. Alternatively, such grip elements may be formed separately from the article and then assembled onto the article. The latter manner of formation of a grip element generally tends to be less expensive and more amenable to mass production, and thus is more desirable.

However, although the actual formation of a separately formed grip element may be simpler than formation of the grip element as an integral element of the article, assembly of the grip element onto the article may be difficult. Because the grip element may increase friction or may be formed from an elastomeric element (for resiliency and cushioning effect), the grip element may not slide easily over the article. Thus, various techniques have been used to facilitate assembly of such grips onto an article. For instance, air may be blasted into the interior of a tubular elastomeric grip element to cause the grip element to expand. The grip element thus may readily be inserted over the grip section of an article. Once the air blast is discontinued, the grip element resumes its natural configuration, which typically has an inner diameter smaller than the outer diameter of the article, so that the grip element is secured onto the article. Similarly, equipment for mechanically stretching a grip element has been used. Alternatively, a lubricant, such as mineral spirits or isopropyl alcohol, may be used to reduce friction between the grip element and the article.

However, the above-mentioned manners of mounting a grip element all have significant drawbacks. Using a blast of air is costly and generally is not desirable. As may be readily appreciated, machinery which mechanically stretches the grip element is not only costly, but also requires precision both in manipulating the grip element as well as in mounting the expanded grip element on the article. Finally, use of alcohol or other types of lubricants which are potentially flammable near assembly equipment has clear inherent risks.

Accordingly, it would be desirable to improve the manner in which a grip element is mounted onto an article such that costs are reduced, and speed and efficiency in assembly are increased.

SUMMARY OF THE INVENTION

The present invention is directed to a grip element for assembly onto a free end of a hand-held, finger-held, or finger-manipulated article. One application of the grip element is to provide a comfortable grip for finger-manipulated articles, such as writing instruments, razors, toothbrushes, utensils, and tools. The grip element can also be used with larger articles that may be held in the palm of the user's hand, such as impact tools (e.g., hammers), various sports equipments (e.g., rackets, bats, golf clubs), and motor-driven devices (e.g., power drills or motorcycles). The variety of articles on which the grip element of the present invention may be mounted are referenced herein as "gripped articles" for the sake of convenience only, and not with any intended limitation.

The grip element referenced herein includes a gripping surface and an engagement surface extending from the gripping surface. The engagement surface is configured and dimensioned for engagement by a pushing device such that the pushing device may move the grip element substantially completely onto the gripped article without requiring lubrication or separate expansion of the grip element. For example, the engagement surface may be a substantially planar surface that is angled, or perpendicular to, the gripping surface. The engagement surface is preferably provided at a distal end of the grip element, which is located furthest away from the proximal, free end of the article. Thus, the pushing device pushes the engagement surface onto the gripped article, effectively pulling the rest of the grip element.

To ease assembly of the grip element onto the gripped article, the inner diameter of the grip element may increase, or taper outwardly, in a direction from a proximal end of the grip element (closest to the pushing device), toward a distal end of the grip element (furthest from the pushing device). In addition, the inner diameter of the grip element at the grip element distal end may be larger than the outer diameter of the grip section at the grip section proximal end, thus allowing the distal end of the grip element to slide readily over at least a portion of the grip section. Further, the inner diameter of the grip element at the grip element proximal end may be smaller than the outer diameter of the grip section at the grip section proximal end to assist in retaining the grip element on the gripped article.

The present invention is also directed to a gripped article incorporating the grip element. The article includes a grip section for receiving the above-described grip element.

The present invention is also directed to a method of assembling a grip element onto a gripped article. The method includes the steps of contacting an engagement surface of the grip element, and pushing the engagement surface to move the grip element onto the article. The engagement surface may be positioned at a distal end of the grip element so that pushing on the engagement surface pulls a gripping portion of the grip element substantially completely onto the grip section of the article. A tubular member, such as a cap (in the case that the grip element is used for a writing instrument), may be slid over the grip element to contact the engagement surface. The method may further include contacting and pushing the end of the grip closest to the free end completely onto the article.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

The present invention is directed to a grip element, which may be applied to any type of gripped article, such as writing instruments, razors, toothbrushes, utensils, and tools. The grip element can also provide grip or shock absorption for articles which transmit impact to the user, such as impact tools (e.g., hammers), various sports equipments (e.g., golf clubs and rackets), and motor-driven devices (e.g., power drills or motorcycles). For each application, the grip element is constructed accordingly to fit onto a given article. For illustrative purposes only, the present invention is shown and described herein as a grip element for a writing instrument.

Figure 1:
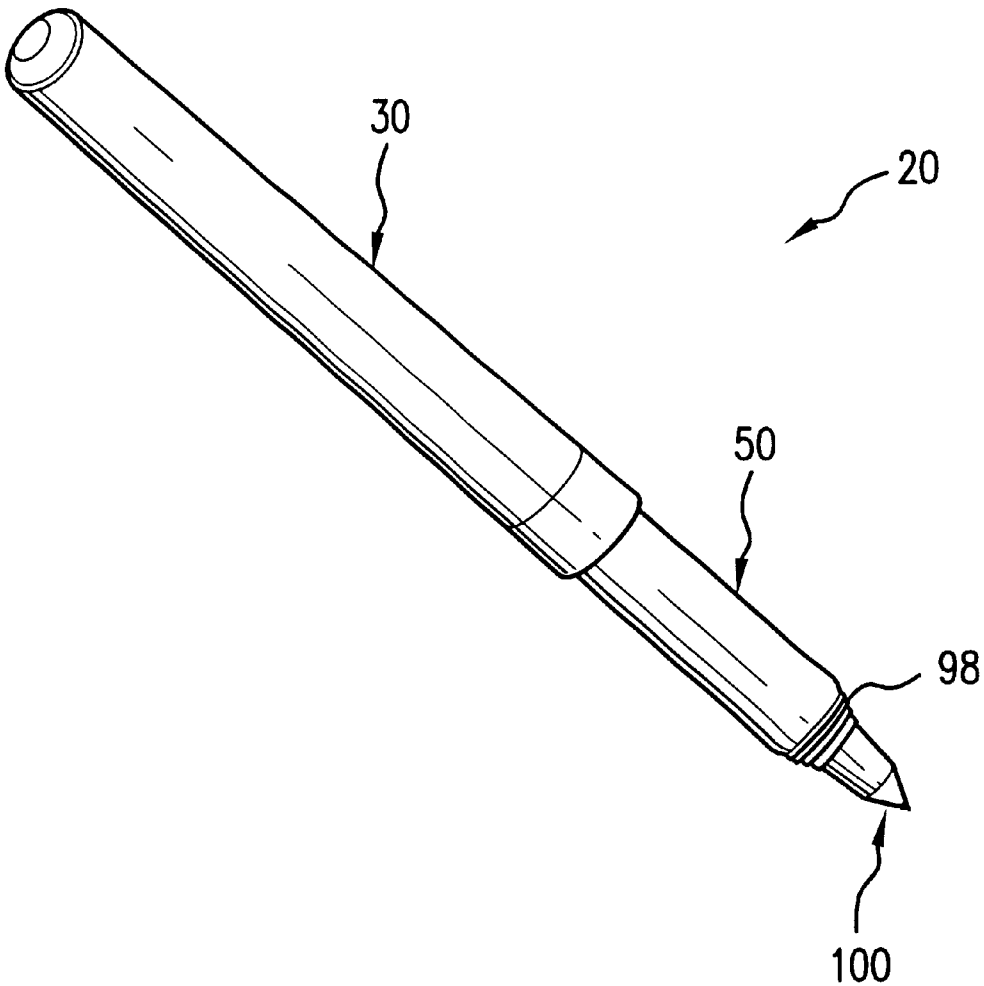
FIG. 1 is a perspective view of an illustrative embodiment of a gripped article according to the present invention, shown as a writing instrument.

Referring to FIG. 1, an illustrative embodiment of a gripped article including a grip element according to the present invention is shown as article 20. Gripped article 20 generally includes an elongated body 30 having a grip element 50 disposed thereon. While body 30 is shown as having a generally circular cross-sectional geometry, other geometries are within the scope of the present invention, including rectangular, square, triangular, oval, and free-form.

Figure 2:
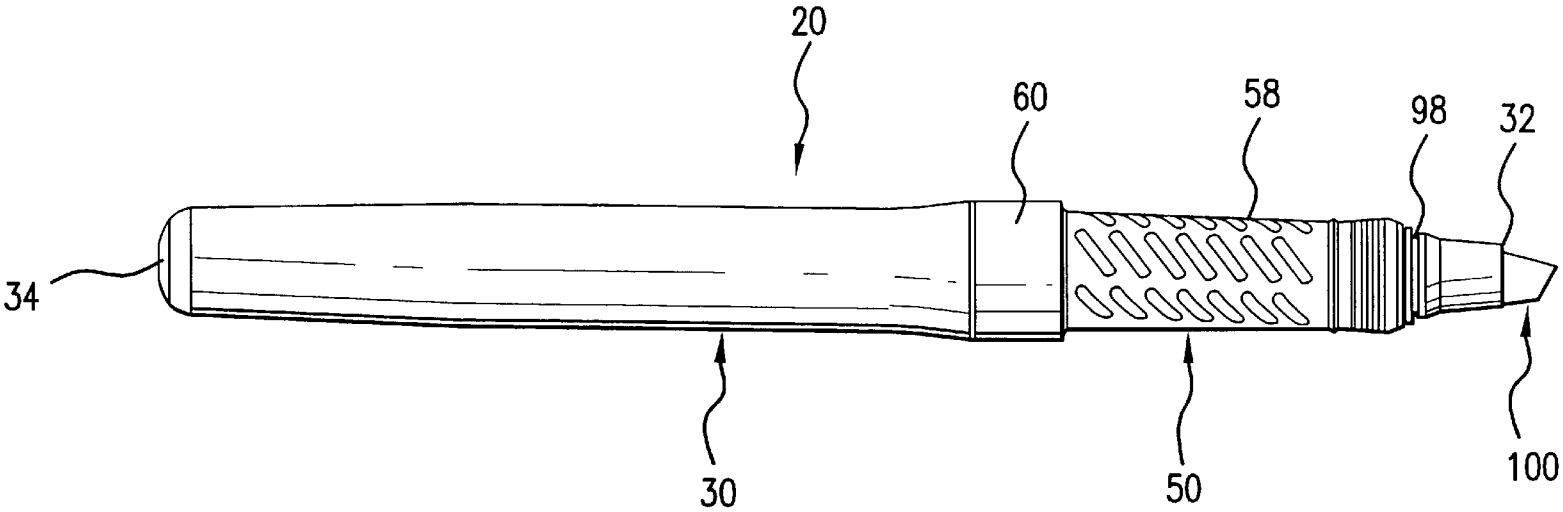
FIG. 2 is a side elevational view of the gripped article of FIG. 1.
Figure 3:
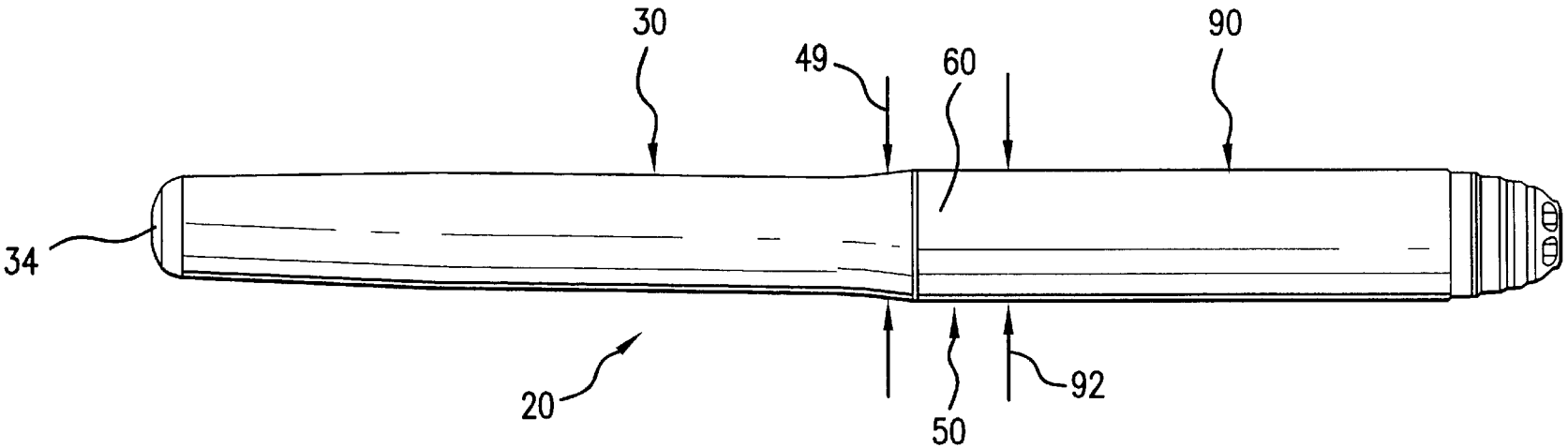
FIG. 3 is a side elevational view of the gripped article of FIG. 1, with a cap covering a free end of the gripped article.
Figure 6:
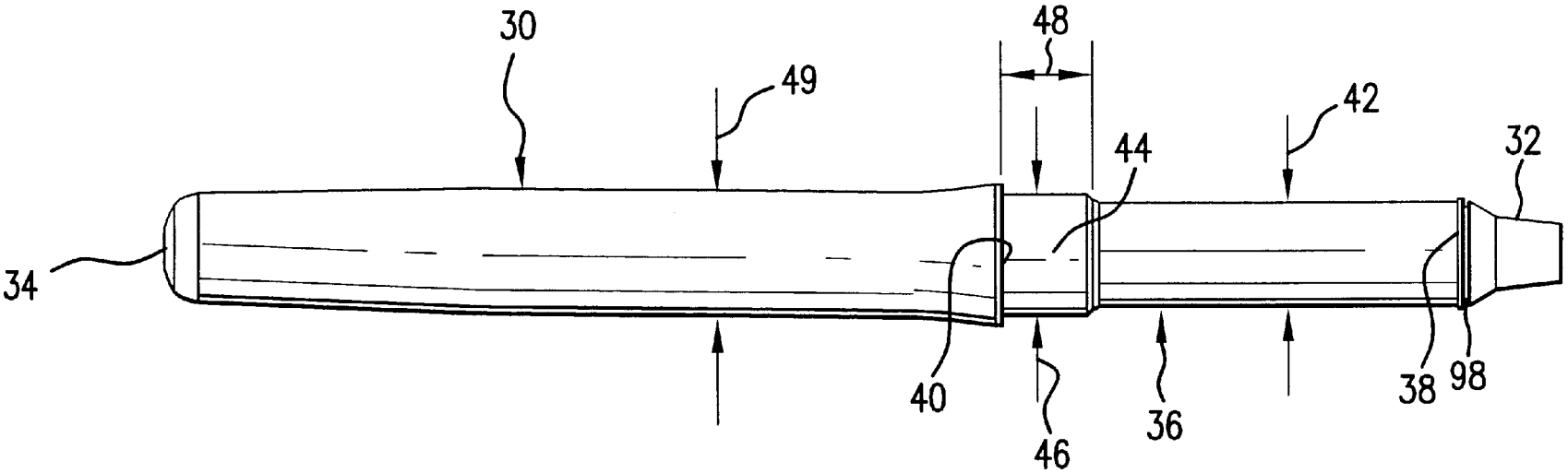
FIG. 6 is a side elevational view of a body of the gripped article of FIG. 1.

Referring to FIGS. 2 and 6, body 30 is a generally elongated member having a first free end 32, a second end 34, and a grip section 36 over which grip element 50 is provided. Typically, body 30 is formed of a relatively rigid material, such as polypropylene. As shown, grip section 36 is located between first free end 32 and second end 34, and is preferably located closer to first free end 32. Second end 34 may or may not be a free end, depending on the application of the grip element 50. Grip element 50 may be positioned substantially adjacent first free end 32 to provide a gripping surface for a user during use of article 20. As shown in FIG. 3, a cap 90 may be placed over first free end 32 (hidden in FIG. 3).

Figure 4:
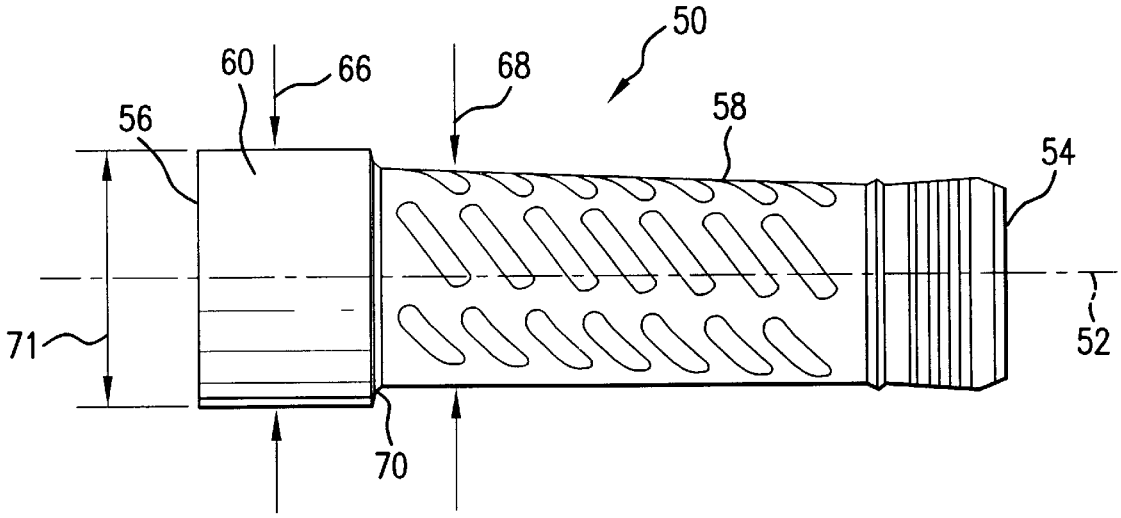
FIG. 4 is a side elevational view of a grip element of the gripped article of FIG.1.
Figure 5:
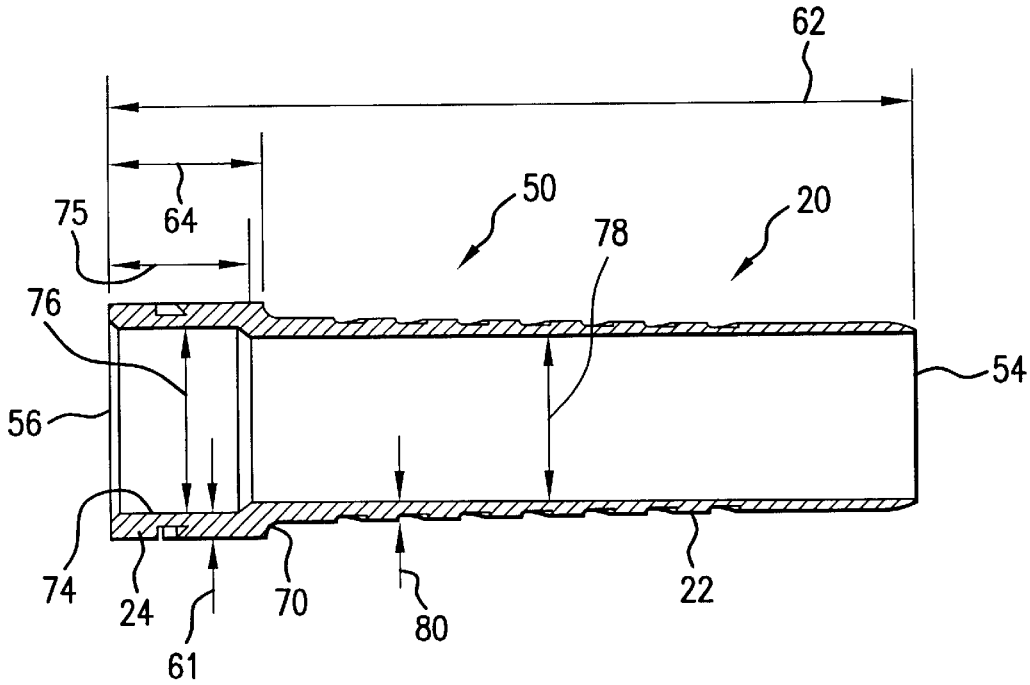
FIG. 5 is a cross-sectional view of the grip element of FIG. 4.

Referring to FIGS. 4 and 5, an illustrative embodiment of grip element 50 is shown. Grip element 50 may be formed from an elastomeric material such as rubber or foam, but other materials known by one of ordinary skill in the art to be suitable for gripping are also within the scope of the present invention. For example, grip element 50 may be formed from a polypropylene based thermoplastic elastomer such as QX60 sold by Teknor Apex of Pawtucket, R.I., having a Shore A durometer of 60. Grip element 50 is preferably tubular in shape and defines a longitudinal axis 52 between a proximal end 54 and a distal end 56 which are longitudinally spaced from one another. Distal end 56 is longitudinally spaced from first free end 32. As used herein, and as shown in the figures, proximal generally refers to a position adjacent the location from which grip element 50 is provided for assembly (adjacent a pushing device), and distal generally refers to a position spaced therefrom, away from the location from which grip element 50 is assembled over body 30 (and away from the pushing device).

As shown in FIGS. 4 and 5, grip element 50 includes a gripping surface 58 for gripping by a user. The gripping surface 58 defines the longitudinal axis of the grip element 50. Gripping surface 58 may optionally be provided with texture (e.g., a raised or recessed pattern or an otherwise non-smooth surface) to provide enhanced grip and comfort to a user of gripped article 20. Grip element 50 also includes an engagement surface 70, which is configured for engagement with an assembly tool such that the assembly tool can assemble, or move, grip element 50 onto body 30. The engagement surface 70 is located substantially adjacent the distal end 56. More particularly, engagement surface 70 is disposed at an angle with respect to gripping surface 58 and has an outer diameter 71 (shown in FIG. 4) that is sufficiently larger than outer diameter 68 of gripping surface 58 (shown in FIG. 4) to permit secure engagement by the assembly tool against engagement surface 70. Preferably, engagement surface 70 includes a substantially planar portion that is oriented substantially perpendicular or transverse to gripping surface 58. An assembly tool may thus be placed in contact with engagement surface 70, and moved with respect to body 30 to push grip element 50 onto body 30. Preferably, the engagement of the assembly tool or pushing device against engagement surface 70 is sufficient enough that additional assembly tools or pushing devices are not necessary for completely assembling grip element 50 onto body 30, i.e., assistance of additional assembly tools or pushing devices is not necessary and the pushing device can push grip element 50 independently. When grip element 50 is oriented such that engagement surface 70 slides onto body 30 before gripping surface 58 (e.g., when engagement surface 70 is located at a distal end of grip element 50), only engagement surface 70 is pushed onto body 30, and gripping surface 58 is effectively pulled onto body 30. Because most of grip element 50 is thus pulled onto body 30, and not pushed, deformation of grip element 50, such as bunching or collapsing, is substantially avoided.

A band 60, shown in FIG. 4, may optionally be provided on grip element 50 adjacent engagement surface 70. In the case band 60 is provided, it preferably extends distally from engagement surface 70 in a direction substantially along the longitudinal axis. Band 60 preferably has an outer diameter 66 (shown in FIG. 4) that is substantially equal to engagement surface outer diameter 71. As shown in FIG. 5, grip element 50 has an overall length 62 between the grip element proximal and distal ends and band 60 has a band length 64 that may be less than about half of overall length 62. Preferably, band length 64 is about 20% of overall length 62.

Gripping surface 58 and band 60 may be integrally formed, or alternatively formed as two separate parts and joined together, such as by bonding, welding, or any other suitable technique. In the case that gripping surface 58 and band 60 are formed as two separate parts and joined together, different materials may be used for each portion to provide desired properties to each of the respective parts, such as hardness, color, etc.

Referring to FIG. 6, grip section 36 is shown. Grip section 36 includes a proximal end 38 and a distal end 40. Proximal end 38 is located proximate the first free end 32 and distal end 40 is longitudinally spaced from proximal end 38 toward a second free end 34 of body 30. Grip element 50 may be dimensioned with respect to grip section 36 to provide, among other benefits, increased ease of assembly of grip element 50 onto grip section 36, as will be described in detail below. More specifically, and with reference to FIGS. 5 and 6, grip element inner diameter 78 may be dimensioned with respect to grip section outer diameter 42 such that grip element 50 slides at least partially onto grip section 36 with substantially no interference between the two parts. The grip section outer diameter 42 at the grip section proximal end 38 is larger than the grip element inner diameter 78 at the grip element proximal end 54. Thus, grip element 50 need not be treated or further manipulated as in the prior art. Preferably, these two diameters 78, 42 are dimensioned such that grip element 50 may slide at least half way onto grip section 36 with little or no interference. This may be accomplished by providing grip element 50 with an inner diameter 78 at grip element distal end 56 that is larger than the outer diameter 42 of grip section 36 at grip section proximal end 38. For example, grip element inner diameter 78 may gradually increase, or taper outward, from grip element proximal end 54 to grip element distal end 56. Similarly, grip section outer diameter 42 may gradually increase, or taper outward, from grip section proximal end 38 to grip section distal end 40.

In addition, grip section outer diameter 42 may, at at least a relatively short extent of grip section 36 proximal to grip section distal end 40, be smaller than grip element inner diameter 78 at grip element distal end 56. Grip section outer diameter 42 at distal end 40, however, preferably is larger than grip element inner diameter 78 at grip element distal end 56. Thus, grip element 50 may be positioned on grip section 36 with little or no interference until grip element distal end 56 approaches grip section distal end 40. An assembly tool may then be used to engage and to push engagement surface 70 until grip element distal end 56 is moved completely over grip section distal end 40. Contact at or near grip element distal end 56 and grip section distal end 40 may thus primarily secure grip element 50 on grip section 36 by virtue of the differences in the respective outer and inner diameters. This configuration of grip element 50 and grip section 36 allows grip element 50 to be assembled onto grip section 36 without requiring lubrication or expansion of grip element 50 by compressed air or other mechanical assistance. Alternatively or additionally, grip element inner diameter 78 may, at a relatively short extent of grip element proximal end 54, be smaller than grip section outer diameter 42 at grip section proximal end 38. Thus, grip element 50 may additionally or alternatively be secured to grip section 36 by contact with grip section 36 at or near grip element proximal end 54 and grip section proximal end 38.

As further shown in FIGS. 5 and 6, a recess 74 may be formed in grip element 50 and define a recess inner diameter 76 that is larger than gripping surface inner diameter 78. Recess 74 may be provided proximate grip element distal end 56 and further ease assembly of grip element 50 onto grip section 36. Additionally or alternatively, a seat 44 may be provided adjacent grip section distal end 40, and have a seat outer diameter 46 that is greater than grip section outer diameter 42. Seat outer diameter 46 may be substantially equal to, or slightly larger than, recess inner diameter 76 to further secure grip element 50 on grip section 36. Seat 44 has a seat length 48 that is preferably substantially equal to a recess length 75 of recess 74 (shown in FIG. 5).

Grip element 50 may be configured such that it does not collapse upon itself during assembly onto body 30. Additionally or alternatively, grip element 50 may be configured to substantially resist deformation as it is assembled onto body 30. This may be accomplished by forming grip element 50 from a material having a sufficient hardness or reduced flexibility, and/or by configuring grip element 50 to have a sufficient wall thickness 80 (shown in FIG. 5). Materials having a durometer of between about 50 and 70 Shore A hardness have been found suitable to prevent deformation. In addition, the thickness of band 60 preferably is selected such that band 60 does not collapse or otherwise deform as it is pushed over grip section 36 to mount grip element 50 onto grip section 36. For instance, the thickness 61 of band 60 (shown in FIG. 5) preferably is approximately 1 mm for a grip made of a thermoplastic elastomer with an approximately 60 Shore A hardness. Typically, a 10:1 ratio between the effective length of band 60 along thickness 61 is desirable to prevent deformation of band 60 during assembly.

Figure 7:
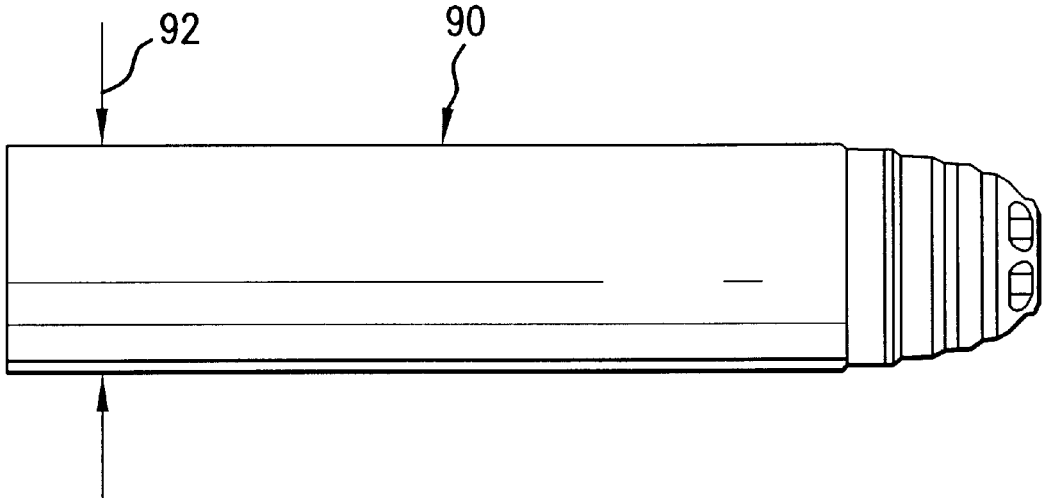
FIG. 7 is a side elevational view of the cap of FIG. 3.
Figure 8:
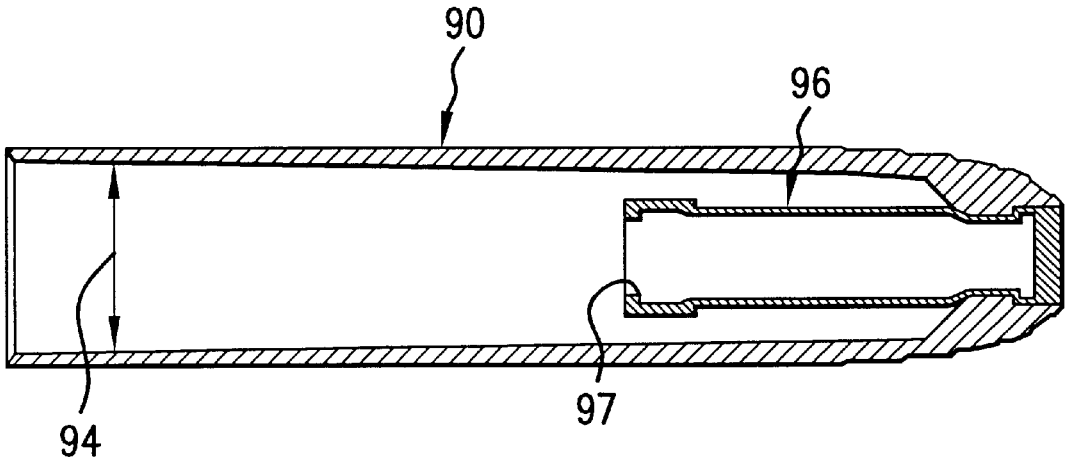
FIG. 8 is a cross-sectional view of the cap of FIG. 7.

Referring to FIGS. 7 and 8, an illustrative embodiment of a cap 90, which may be positioned over the first free end 32 of body 30, when formed as a writing instrument, is shown. Cap 90 preferably has an inner diameter 94 (shown in FIG. 8) that is slightly larger than outer diameter 68 of gripping surface 58 (shown in FIG. 4), thus allowing cap 90 to slide freely over first free end 32 of body 30, for example to conceal writing element 100. When cap 90 is completely seated on body 30, at least a portion of grip element 50 may extend outside cap 90. For example, as shown in FIG. 2, band 60, if provided, may extend outside cap 90 and be visible and touchable by a user of gripped article 20.

Cap 90 may be retained on body 30 solely by engagement with first free end 32 of body 30, without engaging grip element 50. For example, as shown in FIGS. 6–8, a resilient member 97 (shown for illustrative purposes only as a resilient ring) may be associated with cap 90 and configured and dimensioned to snap onto a cap receiving section 98 formed on first free end 32. According to this configuration, inner diameter 94 of cap 90 (shown in FIG. 8) may be larger than outer diameter 68 of gripping surface 58 (shown in FIG. 4), thus preventing any wear or abrasion on grip element 50 when cap 90 is removed and replaced on body 30. One of ordinary skill in the art will know and appreciate that this feature of the present invention is not limited to the resilient member 97 and cap receiving section 98, and that other configurations may be utilized to hold cap 90 on first free end 32.

Still referring to FIGS. 6–8, a vapor seal 96, shown in FIG. 8, may optionally be provided on cap 90 to seal first free end 32 of gripped article 20. This may be required when writing element 100 includes a volatile marking medium. In the instance where vapor seal 96 is provided, resilient member 97 may be disposed on vapor seal 96, such that vapor seal 96 engages cap receiving section 98 and retains cap 90 on body 30. One of ordinary skill in the art will further know and appreciate that vapor seal 96 and resilient member 97 may be provided independently of one another (e.g., resilient member 97 may be provided directly on cap 90, or vapor seal 96 may be provided on cap 90 despite cap 90 being retained on body 30 by attachment to some point other than first free end 32).

The inner and/or outer diameters of body 30, grip element 50, band 60 (if provided), and cap 90 may optionally be dimensioned relative to one other to provide a relatively smooth tapered outer surface of gripped article 20. For example, the outer diameter 92 of cap 90 may be substantially equal to the outer diameter 66 of band 60 where the two parts abut, providing a smooth transition between cap 90 and band 60. In addition, body 30 may have a body outer diameter 49 at second end 34 that is dimensioned such that cap 90 may be snugly slid thereover and secured thereon for storage. Because band 60 has a larger diameter than the proximal portion of body 30 (including grip section 36), and cap 90 must fit over such proximal portion as well as over distal second end 34, the diameter 66 of band 60 is larger than the diameter of distal second end 34 as well as of grip section 36. Accordingly, body 30 may have a body transition outer diameter 49, shown in FIG. 3, in order to provide a smooth transition between first free end 32 of body 30 and band 60 for an overall streamlined appearance when cap 90 is covering writing element 100. Furthermore, body transition outer diameter 49 may gradually decrease in a direction from band 60 to second end 34, such as by tapering toward second end 34.

Figure 9:
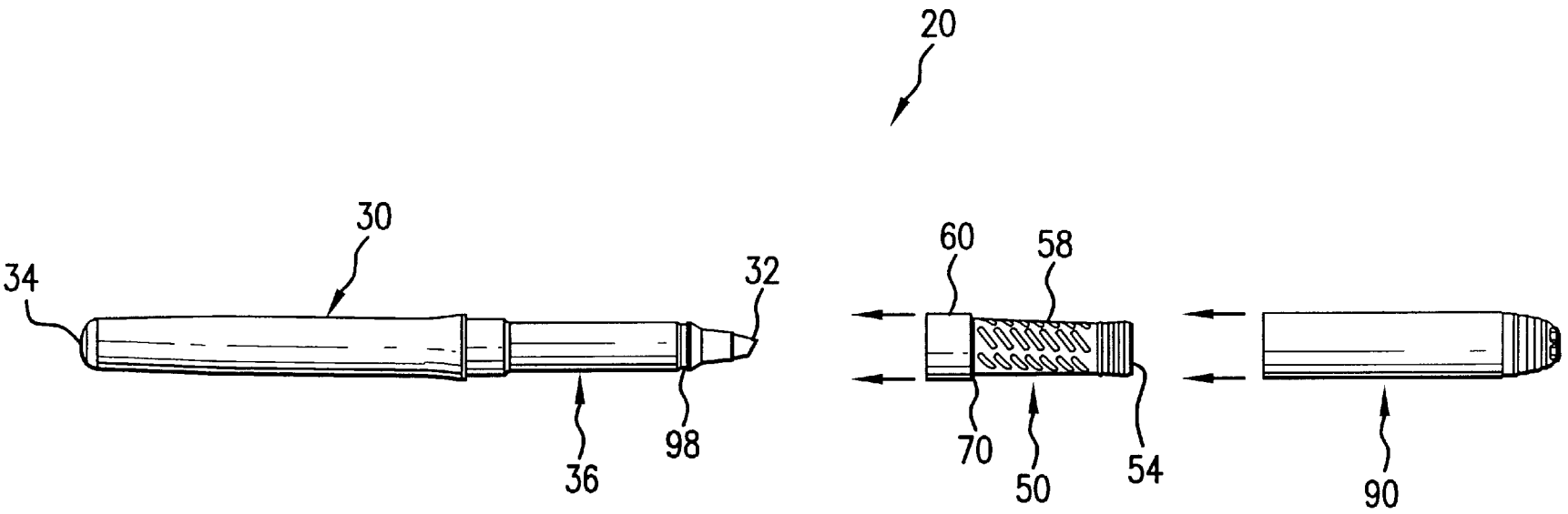
FIG. 9 is schematic representation of a method of assembling a grip element onto a gripped article.

Referring to FIG. 9, a method of assembling a grip element 50 onto a grip section 36 of a gripped article is shown. To facilitate assembly of gripped article 20, grip element 50 may be mounted at least partially onto grip section 36 and seated thereon in proper alignment with grip section 36 without much effort, thus providing a "lead." This may be accomplished, for example, by aligning grip element 50 over first free end 32 and dropping it thereon such that the grip element 50 is substantially stabilized on the article 20 prior to contacting the engagement surface 70 and moving the engagement surface 70 onto the article 20. Grip element 50 preferably freely slides at least about half way onto grip section 36 (as a result of the relative dimensions of grip element 50 and grip section 36) without requiring any moving force applied to engagement surface 70 and with substantially no interference between the grip element 50 and the grip section 36, thus providing a long "lead" for assembly at high speeds. This long "lead" is especially desirable for high speed assembly so the parts fit together and are seated in proper alignment before any force is applied to the grip element 50 to seat grip element 50 completely. The grip element inner diameter 78 is larger than the grip section outer diameter 42 along at least about half of the grip element length 62 such that the grip element 50 may be freely dropped over the grip section 36. Next, an assembly tool may contact and push engagement surface 70 to move engagement surface 70 along grip section 36. As a result, gripping surface 58 is pulled onto grip section 36. The assembly tool may include a tubular portion that is received over gripping surface 58 and contacts and pushes against engagement surface 70 to push grip element 50 onto grip section 36. In the case where the outer diameter 42 at the proximal end 38 of grip section 36, closest to first free end 32, is larger than the inner diameter 78 at proximal end 54 of grip element 50 (described above in reference to FIG. 6), it may be preferable to contact and to push proximal end 54 of grip element 50 onto grip section 36, to fully seat grip element 50 on body 30.

According to an alternative embodiment, cap 90 may be used to assemble grip element 50 onto grip section 36. For example, cap 90 may have a wall thickness and/or inner diameter 94 that is dimensioned to make sufficient contact with engagement surface 70 to push grip element 50 onto grip section 36. Thus, after grip element 50 is at least partially mounted onto grip section 36, as discussed above, cap 90 may be placed at least partially over grip element 50 and placed in contact with engagement surface 70. Cap 90 may then be moved further to push grip element 50 completely onto grip section 36. If cap 90 is provided with a vapor seal 96, as shown in FIGS. 7 and 8, the vapor seal 96 may be dimensioned and configured to engage proximal end 54 of grip element 50 and filly seat grip element 50 onto body 30. By using cap 90 as the assembly tool, the efficiency of assembling gripped article 20 is increased by installing grip element 50 and cap 90 onto body 30 in a single operation.

Although the above method is illustrated and discussed in reference to components of a writing instrument, this is for illustrative purposes only, and the present inventive method is in no way to be limited to any of the above-described structures. Thus, a grip element may be formed and assembled in accordance with the principles of the present invention for assembly over any gripped article.

Furthermore, while the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A grip element for mounting on an article, said grip element comprising:

a gripping surface defining a longitudinal axis of said grip element; and an engagement surface extending transverse to said gripping surface and being adapted to be configured and dimensioned for engagement by a pushing device such that said pushing device sufficiently engages said engagement surface to push said grip element on said article without requiring assistance of an additional assembly tool;

wherein said grip element is adapted to be configured and dimensioned to be moved substantially completely onto said article without requiring treatment or further manipulation of said grip element.

2. The grip element of claim 1, wherein said engagement surface is substantially planar and disposed at an angle relative to said gripping surface.

3. The grip element of claim 2, wherein said engagement surface is substantially perpendicular to said gripping surface.

4. The grip element of claim 1, wherein:

a band extends from said engagement surface in a direction substantially along said longitudinal axis;

said band defines a band outer diameter;

said gripping surface defines a gripping surface outer diameter; and said band outer diameter is larger than said gripping surface outer diameter.

5. The grip element of claim 4, wherein:

a recess is defined in said grip element proximate said band, said recess defines a recess inner diameter;

said grip element defines a grip element inner diameter; and said recess inner diameter is greater than said grip element inner diameter.

6. The grip element of claim 1, wherein:

said grip element has proximal and distal ends longitudinally spaced from one another;

said grip element proximal end is a free end;

said grip element distal end is longitudinally spaced from said free end; and said engagement surface is located substantially adjacent said distal end.

7. The grip element of claim 1, wherein said grip element substantially resists deformation during movement onto the article.

8. The grip element of claim 7, wherein said grip element defines a wall thickness that is adapted to be configured and dimensioned to substantially resist deformation of said grip element during movement onto the article.

9. The grip element of claim 7, wherein said grip element is formed from a material having a hardness sufficient to substantially prevent deformation of said grip element during movement onto the article.

10. The grip element of claim 1, wherein said engagement surface is adapted to be configured and dimensioned for engaging a tubular pushing device.

11. An article comprising:

an elongated body having a first free end;

a grip section disposed on said elongated body; and a grip element defining a longitudinal axis and having a proximal end and a distal end, said grip element having a gripping surface and an engagement surface extending transverse to said gripping surface, said engagement surface configured and dimensioned for engagement by a pushing device such that said pushing device sufficiently engages said engagement surface to push said grip element without requiring assistance of an additional assembly tool, wherein said grip element is configured and dimensioned with respect to said grip section to be moved substantially completely over said elongated body first free end and onto said grip section without requiring treatment or further manipulation of said grip element.

12. The article of claim 11, wherein:

said grip element proximal end is located adjacent said elongated body first free end;

said grip element distal end is longitudinally spaced from said elongated body first free end; and said engagement surface is located substantially adjacent said grip element distal end.

13. The article of claim 12, wherein:

a band extends from said engagement surface in a direction along said longitudinal axis;

a cap is receivable over said elongated body first free end; and said band extends outside said cap when said cap is completely received over said elongated body first free end.

14. The gripped article of claim 13, wherein:

said band defines a band outer diameter;

said cap defines a cap outer diameter; and said band outer diameter is substantially equal to said cap outer diameter where said band abuts said cap.

15. The article of claim 11, wherein said grip element defines a grip element inner diameter that is dimensioned and configured such that said grip element slides at least partially onto said grip section with substantially no interference between said grip element and said grip section.

16. The article of claim 11, wherein:

said grip element is received over said elongated body first free end;

said grip section has a grip section proximal end located proximate said elongated body first free end and a grip section distal end longitudinally spaced from said grip section proximal end toward a second free end of said elongated body;

said grip section defines a grip section outer diameter;

said grip element defines a grip element inner diameter; and said grip element inner diameter at said grip element distal end is larger than said grip section outer diameter at said grip section proximal end.

17. The article of claim 16, wherein said grip section outer diameter at said grip section proximal end is larger than said grip element inner diameter at said grip element proximal end.

18. The article of claim 16, wherein said grip section outer diameter at said grip section distal end is larger than said grip element inner diameter at said grip element distal end.

19. The article of claim 16, wherein said grip section outer diameter gradually increases from said grip section proximal end to said grip section distal end.

20. The article of claim 16, wherein said grip element inner diameter gradually increases from said grip element proximal end to said grip element distal end.

21. The article of claim 16, wherein said grip element defines a grip element length between said grip element proximal and distal ends, and said grip element inner diameter is larger than said grip section outer diameter along at least about half of said grip element length such that said grip element may be freely dropped over said grip section.

22. A method of assembling a grip element having proximal and distal ends onto an article, said method comprising:

contacting an engagement surface located adjacent said grip element distal end with a pushing device; and moving said engagement surface onto said article by pushing said engagement surface with the pushing device, thereby pulling said grip element substantially completely onto said article, without requiring assistance of additional assembly tools.

23. The method of claim 22, further comprising contacting and pushing said grip element proximal end completely onto said article.

24. The method of claim 22, further comprising aligning said grip element over a first free end of said article and dropping said grip element onto said article such that said grip element is substantially stabilized on said article prior to contacting said engagement surface and moving said engagement surface onto said article.

25. The method of claim 24, wherein said grip element slides at least halfway onto said grip section without application of additional moving force to said grip element.

26. The method of claim 22, wherein contacting said engagement surface comprises sliding a tubular portion over said grip element.

27. The method of claim 22, wherein said grip element substantially resists deformation during movement onto said article.

28. An article comprising:

an elongated body having a first free end;

a grip element disposed on said elongated body distal to said first free end and defining a grip element outer diameter; and a cap receivable over said first free end to cover at least a portion of said grip element, said cap defining a cap inner diameter that is slightly larger than said grip element outer diameter;

wherein said cap is retained on said body solely by engagement with said first free end.

29. The article of claim 28, wherein said cap includes a resilient member configured to engage said first free end to retain said cap on said body.

30. The article of claim 29, wherein said resilient member is a resilient ring and said first free end has a cap receiving section configured for engagement by said ring.

31. The article of claim 29, wherein said cap includes a vapor seal, and said resilient member is disposed on said vapor seal.

* * * * *

UNITED STATES PATENT AND TRADEMARK OFFICE

CERTIFICATE OF CORRECTION

PATENT NO. : 6,485,211 B1 
DATED : November 26, 2002
INVENTOR(S) : Henry K. Leo and Craig M. Stevens It is certified that error appears in the above-identified patent and that said Letters Patent is hereby corrected as shown below:

Column 8,
Line 62, replace the word "said" (second occurrence) with -- the --.

Column 9,
Line 1, replace the word "said" with -- the --.

Signed and Sealed this

Twenty-fourth Day of June, 2003

JAMES E. ROGAN
*Director of the United States Patent and Trademark Office*